US012808536B2

(12) United States Patent
Nester et al.

(10) Patent No.: US 12,808,536 B2
(45) Date of Patent: Nov. 24, 2026

(54) THREE CHAMBER REGENERATIVE THERMAL OXIDIZER

(71) Applicant: Nestec, Inc., Pen Argyl, PA (US)

(72) Inventors: Jim Nester, Telford, PA (US); Rick Reimlinger, Manasquan, NJ (US)

(73) Assignee: Nestec, LLC, Pen Argyl, PA (US)

( * ) Notice: Subject to any disclaimer, the term of this patent is extended or adjusted under 35 U.S.C. 154(b) by 894 days.

(21) Appl. No.: 17/334,791

(22) Filed: May 30, 2021

(65) Prior Publication Data

US 2022/0364724 A1 Nov. 17, 2022

Related U.S. Application Data

(63) Continuation of application No. 17/320,211, filed on May 13, 2021.

(51) Int. Cl.

| | |
|---|---|
| ***F23G 7/06*** | (2006.01) |
| ***F28D 19/04*** | (2006.01) |
| ***F28F 27/00*** | (2006.01) |

(52) U.S. Cl.

CPC ..... *F23G 7/06* (2013.01); *F28D 19/04* (2013.01); *F28F 27/006* (2013.01); *F23G 2206/10* (2013.01); *F23G 2209/14* (2013.01)

(58) Field of Classification Search

None

See application file for complete search history.

(56) References Cited

U.S. PATENT DOCUMENTS

| | | | | |
|---|---|---|---|---|
| 5,098,286 A * | 3/1992 | York | F23G 7/068 | 110/211 |
| 8,740,613 B1 * | 6/2014 | Friend | F27B 17/0016 | 165/4 |
| 2004/0123880 A1 * | 7/2004 | Chiles | F23G 7/068 | 134/34 |

FOREIGN PATENT DOCUMENTS

| | | | | |
|---|---|---|---|---|
| CA | 2333870 C * | 3/2009 | F23G 7/068 | |

* cited by examiner

*Primary Examiner* — Michael G Hoang
*Assistant Examiner* — Kurt J Wolford
(74) *Attorney, Agent, or Firm* — Muskin and Farmer LLC

(57) ABSTRACT

A regenerative thermal oxidizer (RTO) with three or more chambers. Each chamber would be in a unique mode, (inlet, outlet, purge). Each chamber has its gas flow determined by two poppet valves which define which mode the chamber will be in: inlet mode, output mode, or purge mode.

2 Claims, 23 Drawing Sheets

FIRST CYCLE - CHAMBER "A" ON INLET & "B" ON OUTLET

NEXT CYCLE - CHAMBER "A" ON OUTLET & "B" ON INLET

REGENERATIVE THERMAL OXIDIZER CROSS SECTION

REGENERATIVE THERMAL OXIDIZER CROSS SECTION

THREE CHAMBER REGENERATIVE THERMAL OXIDIZER

CROSS REFERENCE TO RELATED APPLICATIONS

U.S. application Ser. No. 17/320,211 is incorporated by reference herein in its entirety.

FIELD OF THE INVENTION

The present inventive concept relates to a regenerative thermal oxidizer with chamber flushing, which utilizes a three, or more heat recovery chamber system. Airflow is directed with poppet style valves.

BACKGROUND

Regenerative Thermal Oxidizers (RTOs) are a commonly used anti-pollution device used to clean contaminated air. There are a wide variety of RTO designs (for example see U.S. Pat. Nos. 5,540,584 and 5,262,131, both of which are incorporated by reference herein in their entireties), most of which are customized for a specific purpose. The basic premise is that polluted air is introduced into an RTO in order to be heated to a level sufficient to cause the pollutants to decay or oxidize into carbon dioxide and water, which are far less harmful to human health and the environment than the pollutants themselves would be. The cleaned air may then be cooled before being released back into the environment. In most developed countries, including the U.S., the use of RTOs are required in order to comply with limits set forth in the anti-pollution statutes of each jurisdiction.

RTOs function by directing airflow in a first direction through various types of heat exchange media, which are typically ceramic or a similar material. In a first heat exchange chamber, the polluted air, also referred to a process gas, which can be at any initial temperature of 75-850 degrees Fahrenheit, is heated by the first heat exchange chamber to temperatures of approximately 1450 to 1950 degrees Fahrenheit before passing into a combustion chamber. In the combustion chamber, the heated process gas is mixed with natural gas and combusted, thus destroying most of the pollutants in the process gas via oxidation. The cleaned process gas then passes through a second heat exchange chamber wherein it is cooled from approximately 1950 degrees to temperatures slightly higher than the incoming process gas, before being released as exhaust into the atmosphere. In so doing, the first heat exchange chamber is cooled while the second heat exchange chamber is heated. For this reason, a functioning RTO must periodically reverse the flow of the process gas to ensure that it is heated before reaching the combustion chamber and the treated process gas is cooled after leaving the combustion chamber.

One of the typical features of an RTO is that the flow of the process gas can be reversed, often in cycles lasting sixty seconds to four minutes in duration wherein the first heat exchange chamber can be used for heating the processed air in a first cycle and cooling it in a second cycle while the second heat exchange chamber correspondingly cools the processed air in the first cycle and heats the processed gas in the second cycle. In fact, the heating of the processed gas, which occurs in the first heat exchange chamber in the first cycle, is possible because the first heat exchange chamber was previously heated by passing the combusted processed air through it to cool it during the second cycle. Of course, the same is true of the second heat exchange chamber, which is heated and cooled at opposite times of the first heat exchange chamber.

Control of airflow through RTOs is typically performed by using poppet valves or similar devices. Poppet valves have existed for many decades and are typically a disc-shaped blade mounted on the end of a movable shaft. (The valves used to control airflow in internal combustion engines are variations of the poppet valve.) The disc-shaped blade should be of a suitable size and shape to overlap a seat surrounding a port through which air passes in or out of the valve. When the disc-shaped blade is firmly against the seat, with proper seating force, air is not allowed to flow through the port and when the blade (the blade is also referred to as the disc herein) is not against the seat, and no seating force is applied, air is allowed to flow through the port. The seating force required to seal the port with the plug can be between 100 and 5000 or more pounds of pressure. In RTO's these poppet valves can be quite large, measuring in circumference up to seventy-two (72) inches or more.

FIGS. 1A and 1B (both should be viewed together) are prior art and illustrate the use of a pair of cooperating poppet valves in an RTO. FIG. 1A shows a first configuration, wherein valve A is in a first position and valve B is in a second position (the actual name of the positions is just a matter of semantics), The process gas enters into the RTO via an intake and because of the airtight seals of both valves, the path the gas takes is shown (more on the structure/operation of the RTO is discussed below). After a predetermined time elapses, both valves will simultaneously change to their opposite positions as shown in FIG. 1B. Because of the airtight seals of the valves, the process gas now takes the shown path (going in the opposite direction through the first chamber, combustion chamber, second chamber. After the predetermined amount of time elapses again, both valves will simultaneously change their position back to the positions shown in FIG. 1A, and this cycle continuously repeats. The paths/structure shown in FIGS. 1A, 1B are merely exemplary and different paths/configurations of an RTO can be utilized as well. Due to the forces generated when the discs are touching the seats and compressing the disc spring very robust construction has been necessary to ensure longevity. The more robust the construction the more kinetic energy force is converted to potential at the point of impact.

FIGS. 1C and 1D should be viewed together and illustrate another configuration of a Regenerative Thermal Oxidizer and how the positions of the poppet valves can reverse the flow therein. FIG. 1C shows the first cycle with chamber "A" (the chamber on the left) on inlet and chamber "B" (the chamber on the right) on outlet, while FIG. 1D shows the same RTO but in the next cycle with chamber "A" on outlet and chamber "B" on inlet. This cycle will continuously repeat after a predetermined time passes. Note that while the flow paths in FIGS. 1C, 1D as used in an RTO are not new, FIGS. 1C and 1D show the electronic valve as described herein (as opposed to a pneumatic valve) and thus FIGS. 1C, and 1D are not labeled as "prior art."

The basic design of a regenerative thermal oxidizer ("RTO") 100 is illustrated in FIG. 1E and FIG. 1F. FIG. 1E is a front cross-sectional view of an RTO 100, which is intended to be representative of those that currently exist in the prior art. In this illustration, process gas (polluted air) 101 is introduced into the RTO 100 at the lower left, through a first manifold 102. In this cycle of the RTO 100, flow of the process gas 101 within the first manifold 102 can be controlled by a first manifold poppet valve 103. As discussed in more detail below, when the first manifold poppet valve 103 can be in a first position, wherein the first manifold poppet valve 103 can be open, process gas 101 can be directed through the first manifold 102 into a first chamber 104, which can contain a first set of heat exchange media 114. Such media 114 can be comprised of a ceramic material or a similar material further comprising passageways through which the process gas 101 can flow. The heated process gas 101 can then flow into a combustion chamber 105 comprising a burner 106, which can be fueled by natural gas. The pollutants in the process gas 101 can be ignited by the burner in the combustion chamber in the presence of oxygen thus oxidizing the pollutants, typically organic compounds, to carbon dioxide and water, but also causing the now treated process gas 101 to become extremely hot, typically between 1450 and 1950 degrees Fahrenheit. This treated and heated process gas 101 can then flow through a second chamber 107, which can comprise a second set of heat exchange media 115, comprised of a ceramic material further comprising passageways through which the treated and heated process gas 101 can pass through the media 115 where it is cooled from between 1450 and 1950 degrees Fahrenheit to 100-950 degrees Fahrenheit. The cooled and treated process gas 101 can then flow through a second manifold poppet valve 109 and into an outlet manifold 108 to be directed to an exhaust stack (not shown). As discussed in more detail below, when the second manifold poppet valve 109 is in a first position, process air is directed through the second manifold 102 to the exhaust stack and when the second manifold poppet valve 109 is in a first position, untreated process gas 101 is directed through the second manifold 108 into the second chamber 107.

During the cycle described above, the first set of heat exchange media 114 in the first chamber 104 can be cooled by the untreated process gas 101 as it flows through the first chamber 104. Likewise, the second set of heat exchange media 115 in the second chamber 107 can be heated by the treated process gas 101, which has just been combusted, as it flows through the outlet chamber 107. Therefore, it is necessary to periodically reverse the flow of the process gas 101 through the RTO 100 such that process gas 101 is heated before it enters the combustion chamber 105 and cooled after it leaves the combustion chamber 105. This cycling can be made possible by the first manifold poppet valve 103 and the second manifold poppet valve 109, which can open and close in concert to reverse the flow of process gas 101 through the RTO 100. Such cycle is repeated continuously (e.g., each valve remains in a same position for a predetermined period of time, then both valves reverse their position simultaneously, then remain in that position for the predetermined of time, then both valves reverse their position, and so on.)

SUMMARY OF THE INVENTION

It is an aspect of the present device to provide an improved regenerative thermal oxidizer.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DESCRIPTION OF THE PREFERRED EMBODIMENTS

Figure 1A:
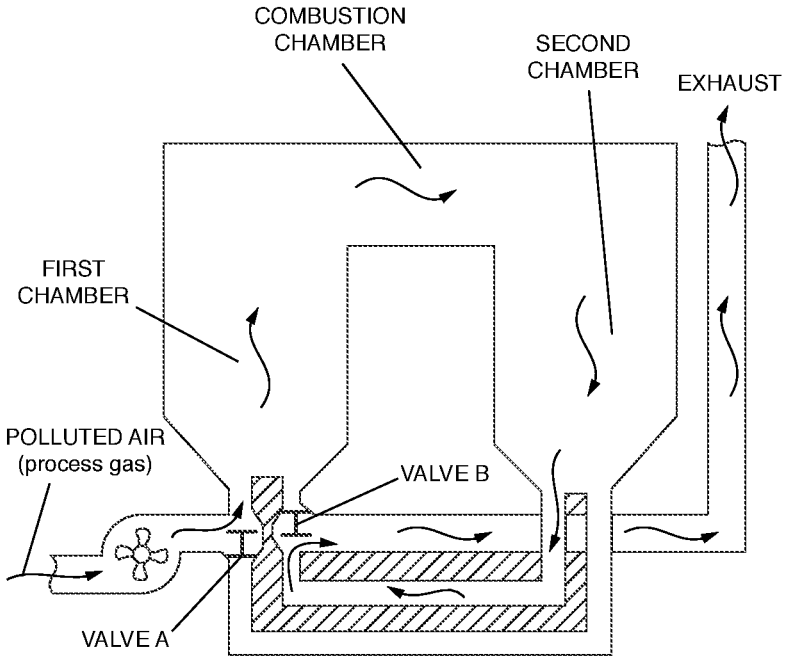
FIGS. 1A and 1B illustrate the use of a pair of cooperating poppet valves in an RTO as known in the art.
Figure 1B:
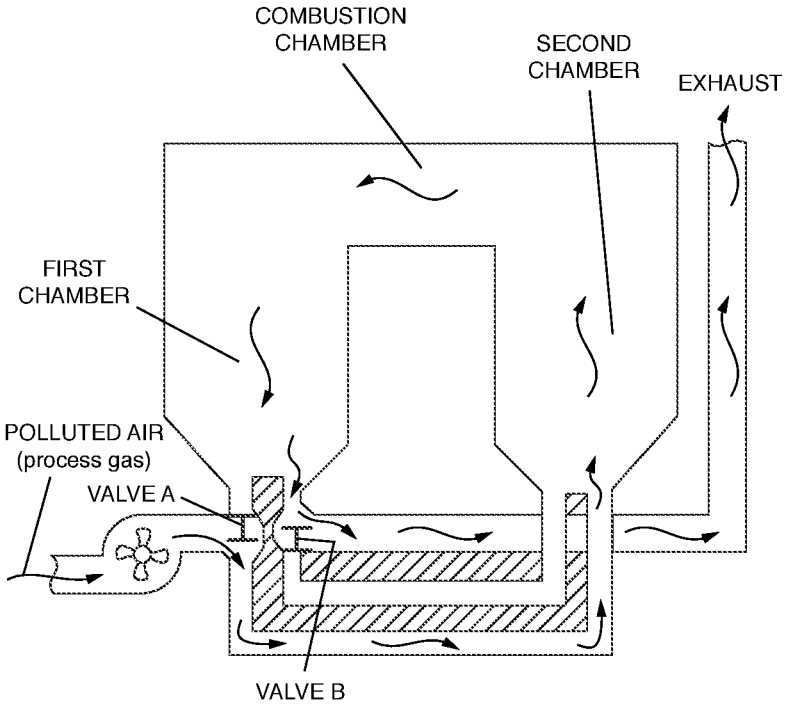
Figure 1C:
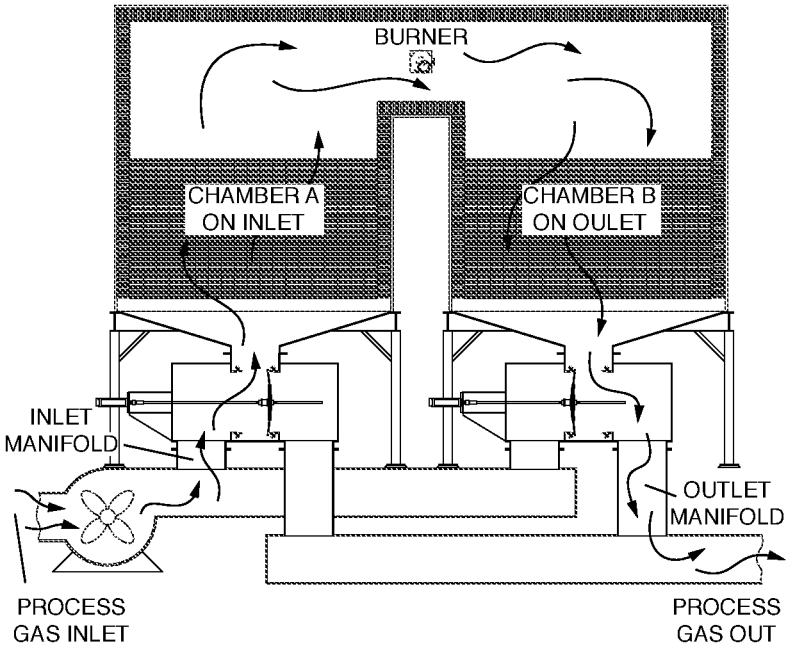
FIGS. 1C and 1D illustrate another configuration of the use of a pair of cooperating poppet valves in an RTO.
Figure 1D:
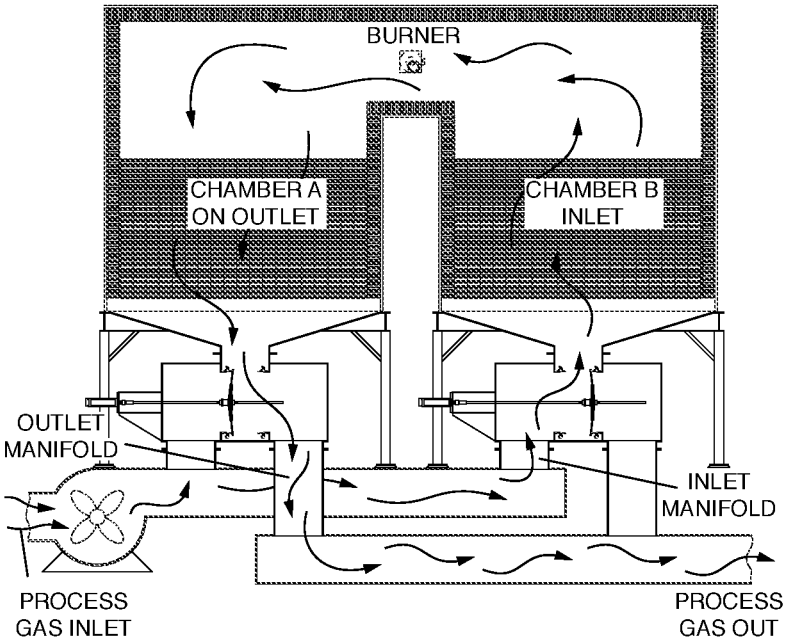
Figure 1E:
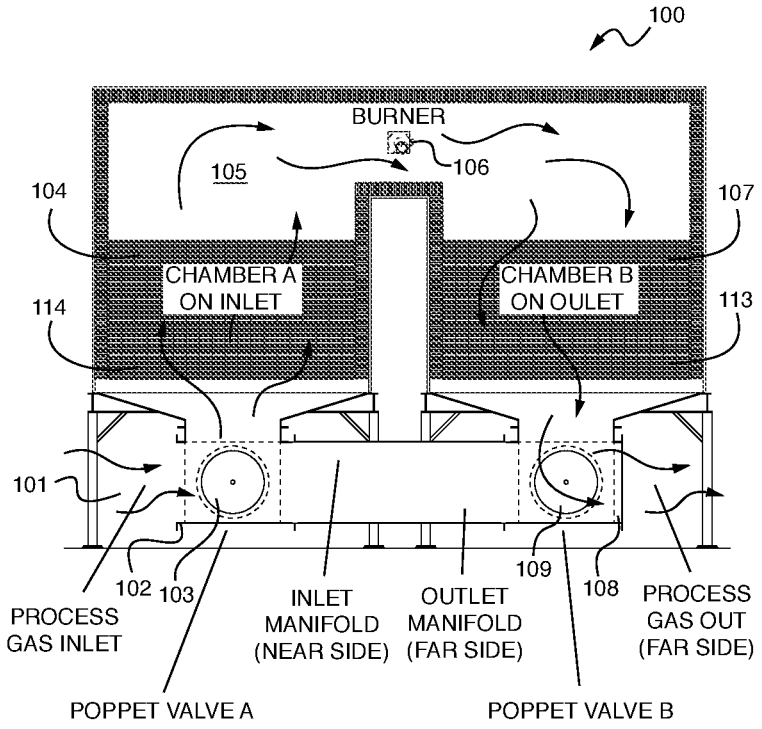
FIG. 1E (PRIOR ART)
FIG. 1E is a front cross-sectional view of a regenerative thermal oxidizer, which is intended to be representative of those that currently exist in the prior art.
Figure 1F:
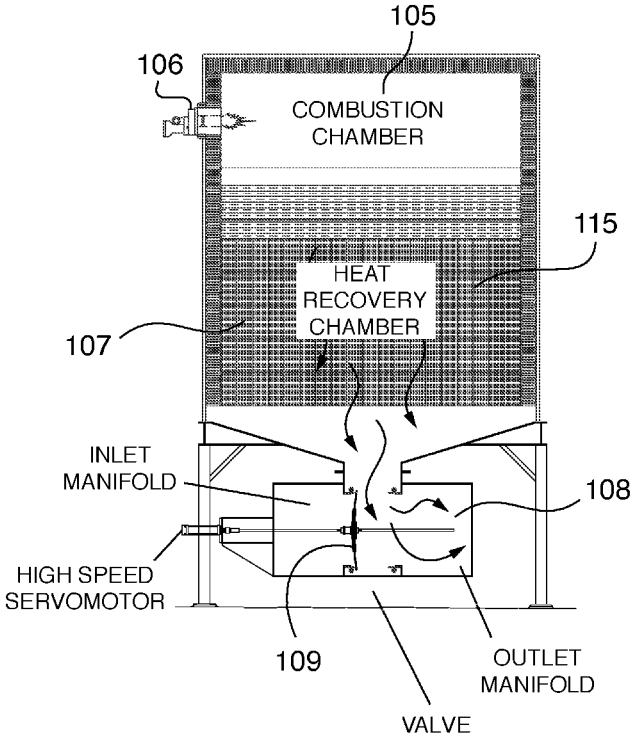
FIG. 1F is a side cross-sectional view of the regenerative thermal oxidizer, which is intended to be representative of those that currently exist in the prior art.

Reference will now be made in detail to the presently preferred embodiments of the invention, examples of which are illustrated in the accompanying drawings, wherein like reference numerals refer to like elements throughout.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present inventive concept relates to a regenerative thermal oxidizer which utilizes three chambers or more. While two of the chambers are being used for gas processing, the third chamber can be in a "purge" mode which flushes (evacuates) the volume of process gas which has not entered the combustion chamber. As a consequence, such an RTO can have higher destruction efficiency as the three chambers are purged in a continuous sequence. Each chamber is associated with two poppet valves, one that provides sealing and prevention of cross contamination and the second poppet valve directs flow to different chambers. These two poppet valves are controlled by a computer to implement different flow sequences which operate the three chamber RTO which utilizes a purge mode.

Table I below shows the steps for each of the valve sequence. The valve sequences would switch from the first valve sequence to the second valve sequence to the third valve sequence and then the cycle repeats itself indefinitely (i.e., from the third valve sequence the RTO would switch back to the first valve sequence, then to the second valve sequence then to the third valve sequence, and then back to the first valve sequence, etc.)

TABLE I

| |
|---|
| FIRST VALVE SEQUENCE: |
| Chamber 010 Outlet Mode switches to Inlet Mode |
| Poppet Valve 010-A Retracts and Poppet Valve 010-B Retracts. |
| Purge Valve 010-C Remains closed. |
| Chamber 020 Inlet Mode switches to Purge Mode |
| Poppet Valve 020-A Remains Retracted and Poppet Valve 020-B Extends. |
| Purge Valve 020-C Opens |
| Chamber 030 Purge Mode switches to Outlet Mode |
| Poppet Valve 030-A Extends and Poppet Valve 030-B Remains Extended. |
| Purge Valve 030-C Closes. |
| SECOND VALVE SEQUENCE: |
| Chamber 010 Inlet Mode switches to Purge Mode |
| Poppet Valve 010-A Remains Retracted and Poppet Valve 010-B Extends. |
| Purge Valve 010-C Opens. |
| Chamber 020 Purge Mode switches to Outlet Mode |
| Poppet Valve 020-A Extends and Poppet Valve 020-B Remains Extended. |
| Purge Valve 020-C Closes. |
| Chamber 030 Outlet Mode switches to Inlet Mode |
| Poppet Valve 030-A Retracts and Poppet Valve 030-B Retracts. |
| Purge Valve 030-C Remains Closed. |
| THIRD VALVE SEQUENCE: |
| Chamber 010 Purge Mode switches to Outlet Mode |
| Poppet Valve 010-A Extends and Poppet Valve 010-B Remains Extended. |
| Purge Valve 010-C Closes. |
| Chamber 020 Outlet Mode switches to Inlet Mode |
| Poppet Valve 020-A Retracts and Poppet Valve 020-B Retracts. |
| Purge Valve 020-C Remains Closed. |
| Chamber 030 Inlet Mode switches to Purge Mode |
| Poppet Valve 030-A Remains Retracted and Poppet Valve 030-B Extends |
| Purge Valve 030-C Opens. |

Figure 2:
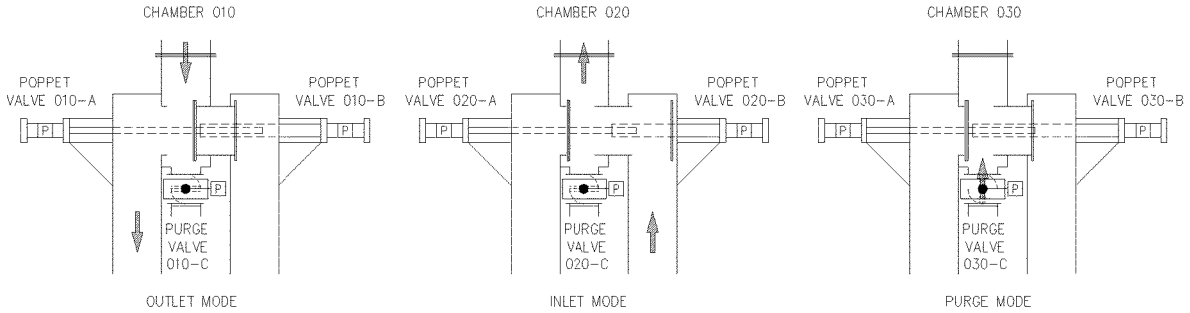
FIG. 2 is a drawing of a third valve sequence showing a first chamber in outlet mode, a second chamber in inlet mode, and third chamber in purge mode, according to an embodiment.

FIG. 2 is a drawing of a third valve sequence showing a first chamber in outlet mode, a second chamber in inlet mode, and third chamber in purge mode, according to an embodiment. This is the third valve sequence.

Figure 7:
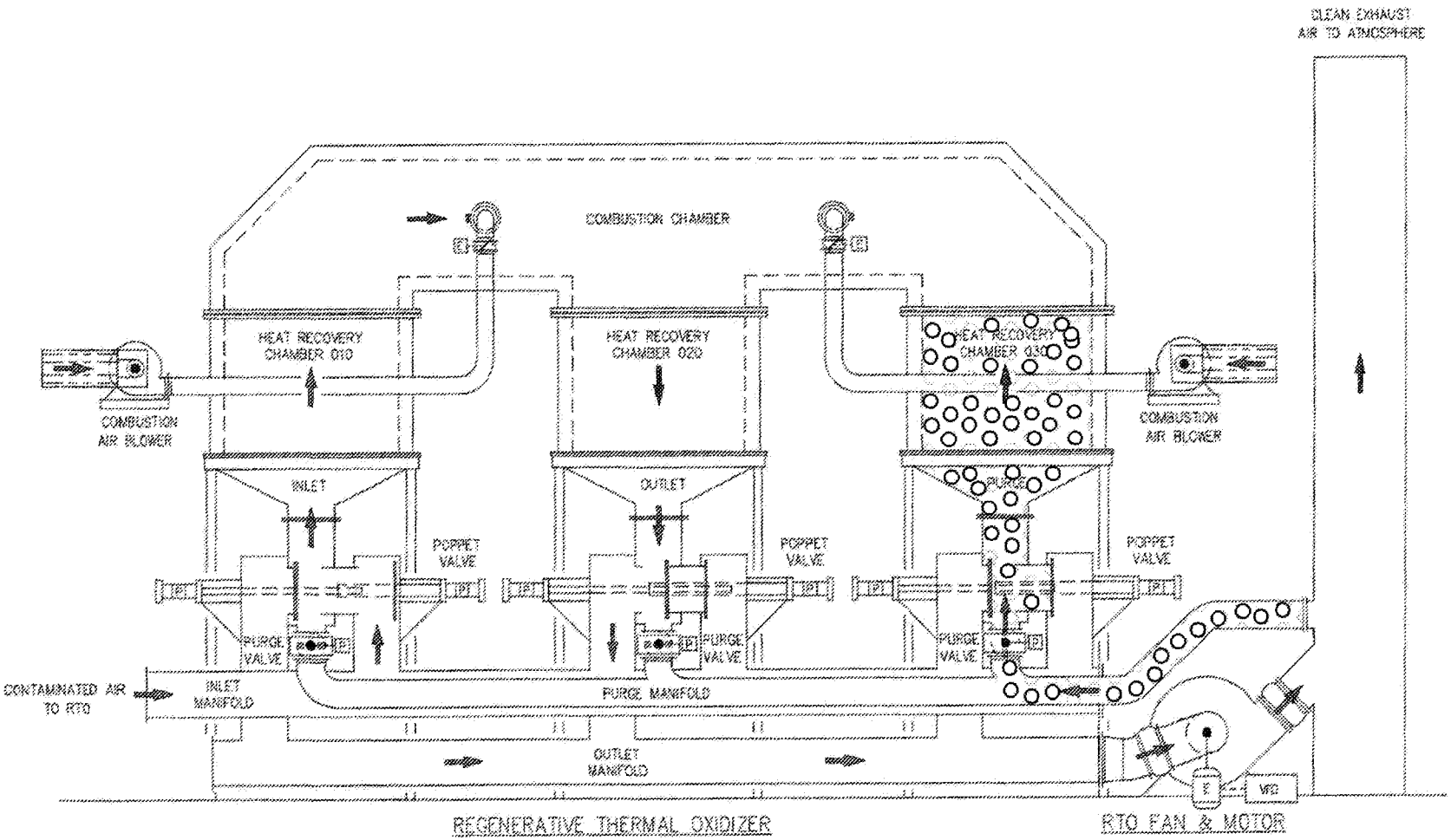
FIG. 7 is a drawing showing the regenerative thermal oxidizer in the third valve sequence, according to an embodiment.

Note that the three chamber RTO depicted in FIG. 7 is in the third sequence. The first chamber 010 is in the outlet mode, the second chamber 020 is in the inlet mode, and the third chamber 030 is in the purge mode.

Note that a valve configuration for the first chamber 010 has a first (left) poppet valve 0010-A and second (right) poppet valve 0010-B. Each of the poppet valves can open and close in order to define which mode the valve configuration (and hence its associated chamber) will be in. In FIG. 2, the first chamber 010 has its first valve open (extended) and its second valve open (extended), causing the gas to flow from the top down as shown by the arrows. This is the outlet mode. A purge valve 010-C is not used in this inlet mode.

Note that a valve configuration for the second chamber 020 has a first (left) poppet valve 0020-A and second (right) poppet valve 0020-B. Each of the poppet valves can open and close in order to define which mode the valve configuration (and hence its associated chamber) will be in. In FIG. 2, the second chamber 020 has its first valve 0020-A closed (retracted) and its second valve 0020-B closed (retracted), causing the gas to flow from the bottom up (towards the combustion chamber) as shown by the arrows. This is the inlet mode. A purge valve 020-C is not used in this the outlet mode.

Note that a valve configuration for the third chamber 030 has a first (left) poppet valve 0030-A and second (right) poppet valve 0030-B. Each of the poppet valves can open and close in order to define which mode the valve configuration (and hence its associated chamber) will be in. In FIG. 2, the third chamber 030 has its first valve closed (retracted) and its second valve open (extended), causing the third chamber to be in the purge mode. In the purge mode, gas from the third chamber 030 has no where to exit but through the purge valve 030-C. The purge valve 030-C (and any purge valve) can selectively open and close, when any purge valve is opened, it allows gas from the respective chamber to flow through the purge valve and into the purge manifold. (see FIG. 7).

Note that each valve configuration has two valves (typically poppet valves although other types of valves can be used) each of which can be independent opened (extended) or closed (retracted). The position of the combined two poppet valves would dictate the flow of gas into or out from the respective chamber connected to the valve configuration. In the purge mode the gas in the chamber has no exit but through a separate purge valve which can be opened (allowing exit of the gas in the chamber) or closed (no exit for the gas in the chamber). When the purge valve is opened, then the gas from the chamber can exit the chamber through the purge valve and flow according to the current available path.

Each sequence has one chamber in outlet mode, one chamber in inlet mode, and one chamber in purge mode. The purge mode is used to flush out (clean) the chamber. While one chamber is in the purge mode, the other two chambers are operating (one in inlet mode and one in outlet mode) so that operation of the RTO does not have to cease. A purge manifold is a pathway connected to all three chambers and is used to flush out the gas in the chamber in the purge mode. Each chamber has a purge valve which when closed, prevents the gas in the respective chamber from exiting to the purge manifold, and when open, allows the gas to enter into the purge manifold where it can then flow according to the path of the purge manifold.

Figure 3:
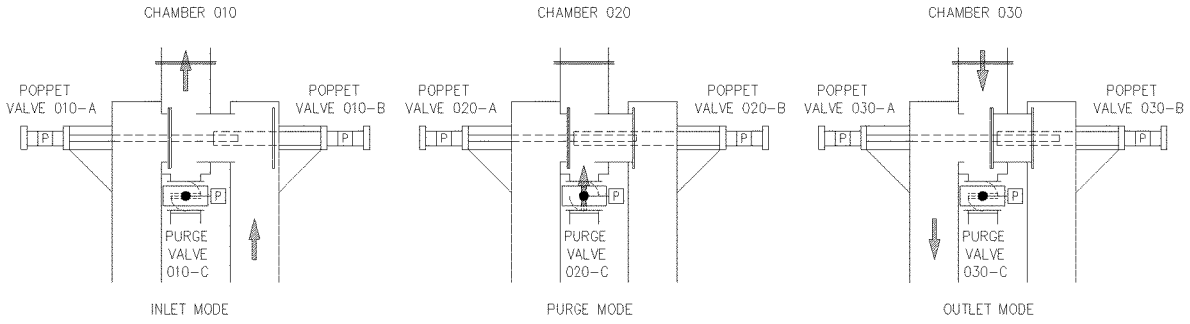
FIG. 3 is a drawing of a first valve sequence showing the first chamber in inlet mode, the second chamber in purge mode, and the third chamber in outlet mode, according to an embodiment.

FIG. 3 is a drawing of a first valve sequence showing the first chamber in inlet mode, the second chamber in purge mode, and the third chamber in outlet mode, according to an embodiment. This is the first valve sequence.

Figure 6:
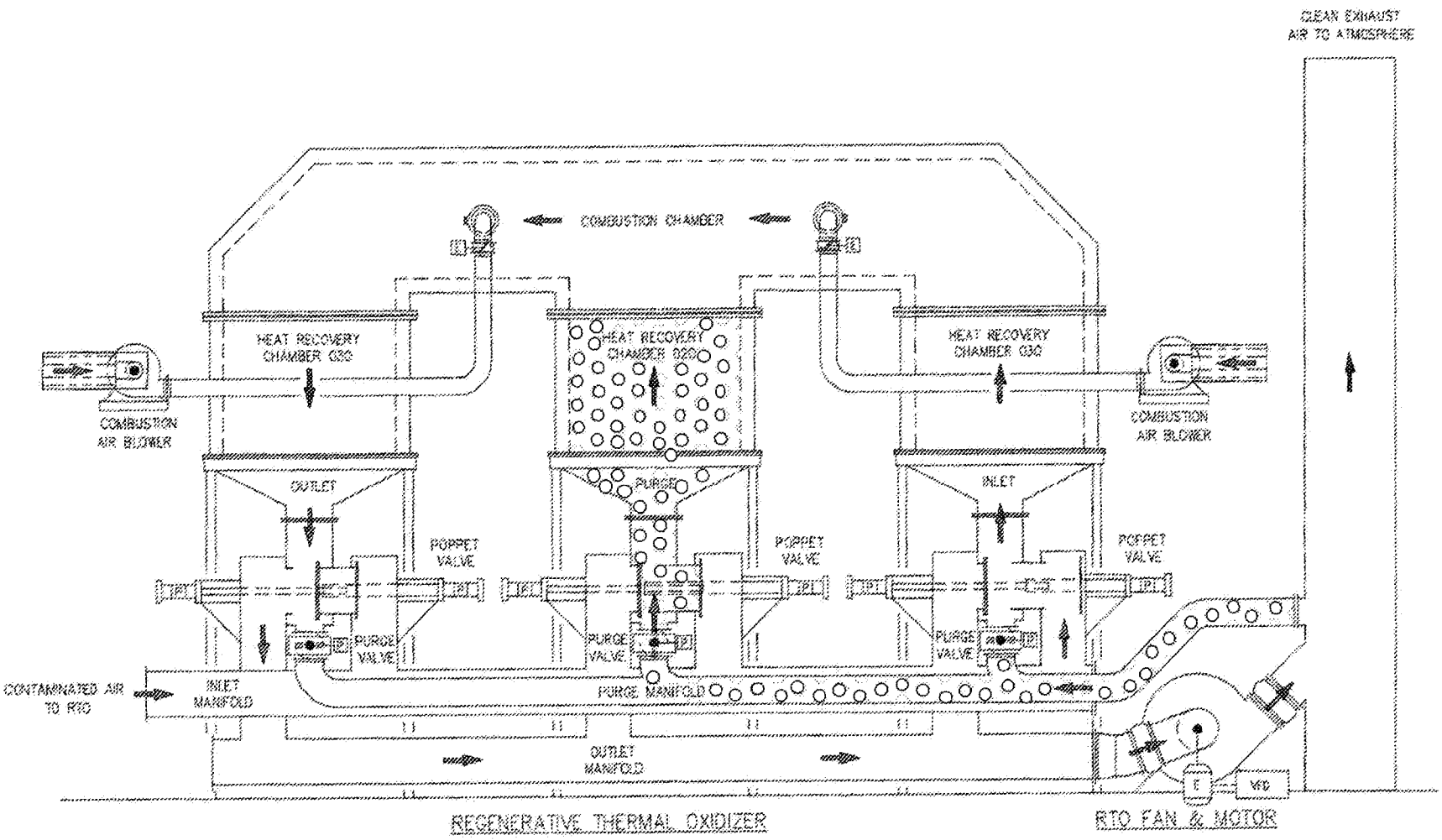
FIG. 6 is a drawing showing the regenerative thermal oxidizer in the first valve sequence, according to an embodiment.

Note that the three chamber RTO depicted in FIG. 6 is in the first sequence. The first chamber 010 is n the inlet mode, the second chamber 020 is in the purge mode, and the third chamber 030 is in the outlet mode.

Figure 4:
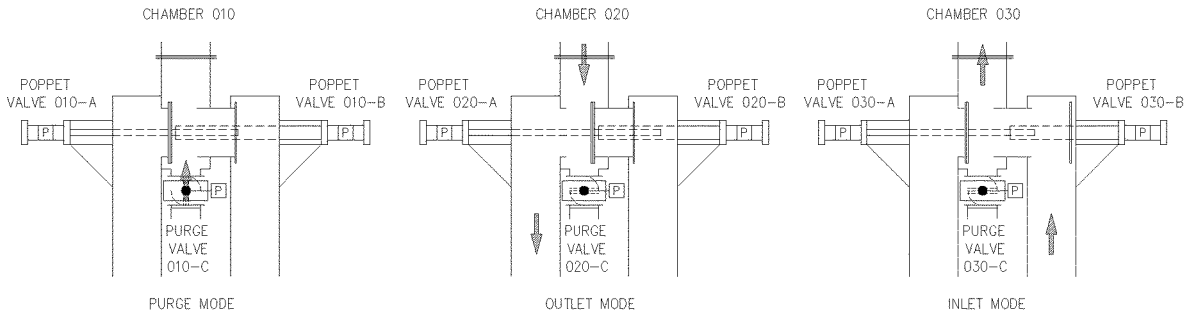
FIG. 4 is a drawing of a second valve sequence showing the first chamber in purge mode, the second chamber in outlet mode, and the third chamber in inlet mode, according to an embodiment.

FIG. 4 is a drawing of a second valve sequence showing the first chamber in purge mode, the second chamber in outlet mode, and the third chamber in inlet mode, according to an embodiment. This is the second valve sequence.

Note that the three chamber RTO depicted in FIG. 7 is in the second sequence. The first chamber 010 is in the purge mode, the second chamber 020 is in the outlet mode, and the third chamber 030 is in the inlet mode.

Please note that Table II illustrates an alternative sequence of valve positions, alternative to Table I:

TABLE II

Figure 5:
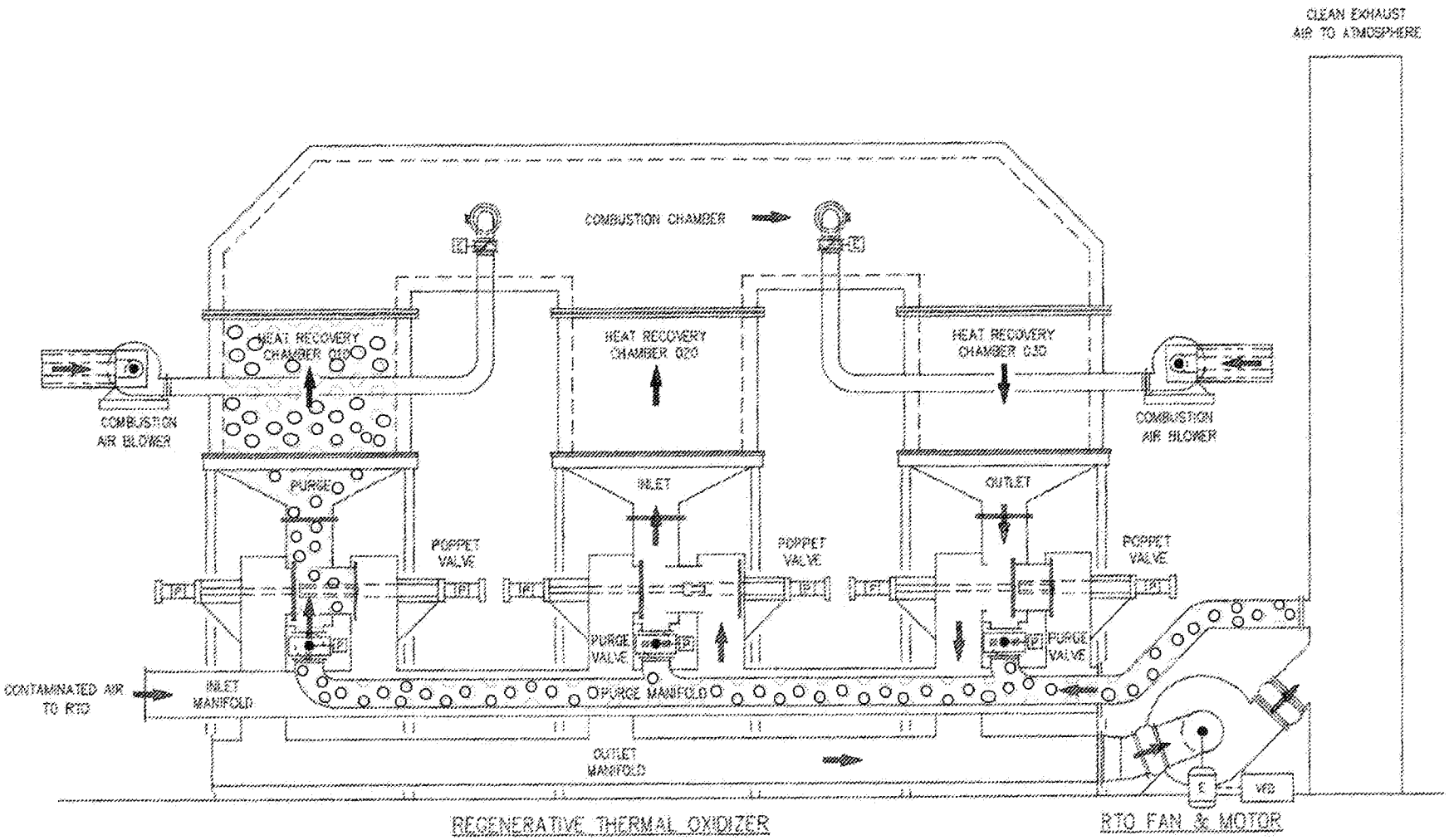
FIG. 5 is a drawing showing a regenerative thermal oxidizer in the second valve sequence, according to an embodiment.

| Alt. sequence | Figure | chamber 010 | chamber 020 | chamber 030 |
|---|---|---|---|---|
| 1 | FIG. 5 | Purge | inlet | outlet |
| 2 | FIG. 6 | outlet | purge | inlet |
| 3 | FIG. 7 | inlet | outlet | purge |

Thus, in this embodiment (and as shown in FIGS. 5-7), the system can start with configuration as shown in FIG. 5 (chamber 010 in purge mode, chamber 020 in inlet mode, chamber 030 in outlet mode), then proceed to FIG. 6 (chamber 010 in outlet mode, chamber 020 in purge mode, chamber 030 in inlet mode), then proceed to FIG. 7 (chamber 010 in inlet mode, chamber 020 in outlet mode, chamber 030 in purge mode), and then repeat the cycle indefinitely (by returning to FIG. 5, then to FIG. 6, then to FIG. 7, and repeating the 3 modes in this order over and over again). Note that after each chamber is in the purge mode, it should then change to outlet mode immediately thereafter (but not inlet mode).

FIG. 5 is a drawing showing a regenerative thermal oxidizer in the alternative sequence one, according to an embodiment.

In FIG. 5, the gas flow is as shown. The gas shown as circles shows the gas flowing into the first chamber 010 from the outside pursuant to the purge mode.

FIG. 6 is a drawing showing the regenerative thermal oxidizer in the alternative second valve sequence, according to an embodiment.

In FIG. 6, the gas flow through the RTO is as shown. The gas shown as circles shows the gas flowing from the outside into the second chamber 020 pursuant to the purge mode. Note that all purge valves can be any type of valve, such as a butterfly valve or rotary valve, which can open and close. Each of the three purge valves can be selectively (individually operated) opened (letting gas/air travel therethrough from the respective chamber to the purge manifold) or closed (preventing any gas/air from passing through to the purge manifold).

As an alternative to FIG. 6, the sequence (see Table II and FIGS. 5-7) could go from alternative sequence 1, to alternative sequence 2, to alternative sequence 3, and then continue back to alternative sequence 1 and repeat indefinitely.

FIG. 7 is a drawing showing the regenerative thermal oxidizer in the alternative third valve sequence, according to an embodiment.

In FIG. 7, the gas flow through the RTO is as shown. The gas shown as circles shows the gas flowing from the outside into the third chamber 030 pursuant to the purge mode.

Figure 8:
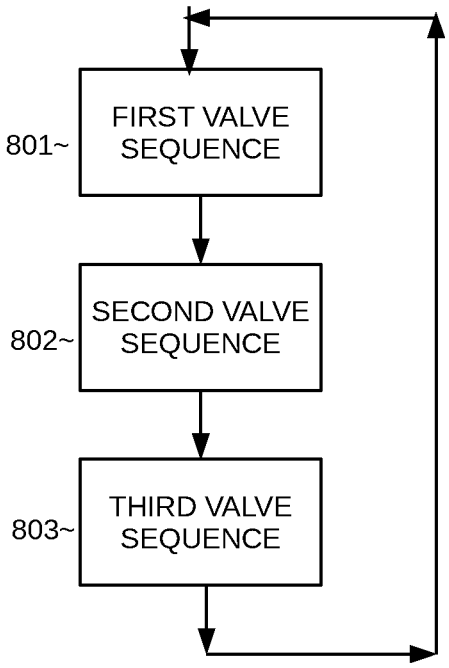
FIG. 8 is a flowchart illustrating a progression of valve sequences, according to an embodiment.

FIG. 8 is a flowchart illustrating a progression of valve sequences, according to an embodiment. Note that the progression can begin in any of the three sequences.

In operation 801, the valves in the RTO are positioned in the first sequence described herein.

From operation 801, the method proceeds to operation 802, in which the valves in the RTO are positioned to the second sequence described herein.

From operation 802, the method proceeds to operation 803, in which the valves in the RTO are positioned to the third sequence described herein.

From operation 803, the progression can return to operation 801 wherein the valves in the RTO are positioned back to the first sequence and the progression continues.

Note that FIG. 8 can also implement the alternate sequence from Table II (i.e., 801 implements alternate 1 sequence, 802 implements alternate 2 sequence, 803 implements alternate 3 sequence) and then repeats as shown.

Each of the three sequences can last for a duration of 10 seconds to 5 minutes (or any other time) before the progression proceeds to the next step. The sequence is conducted automatically and a digital computer can control the position of each of the valves in accordance with the current sequence. Note that in the alternative, instead of the order shown in FIG. 8, the valve sequences can be switched to in any alternative order of the three valve sequences.

Note that there are four purge modes: Recirculation of the flushing volume back to the inlet of the RTO system, use of recirculated stack air to flush the process gasses into the combustion chamber, Use of outside air to flush process gases into the combustion chamber and use of a separate (combustion blower) fan to recirculate the process gases to the combustion chamber or to be used as burner combustion air. Mode of force for the four modes is supported with either a forced draft or induced draft main RTO fan orientation FIG. 9 shows the RTO with the first chamber in a combustion blower purge mode (second valve sequence), according to an embodiment.

Figure 10:
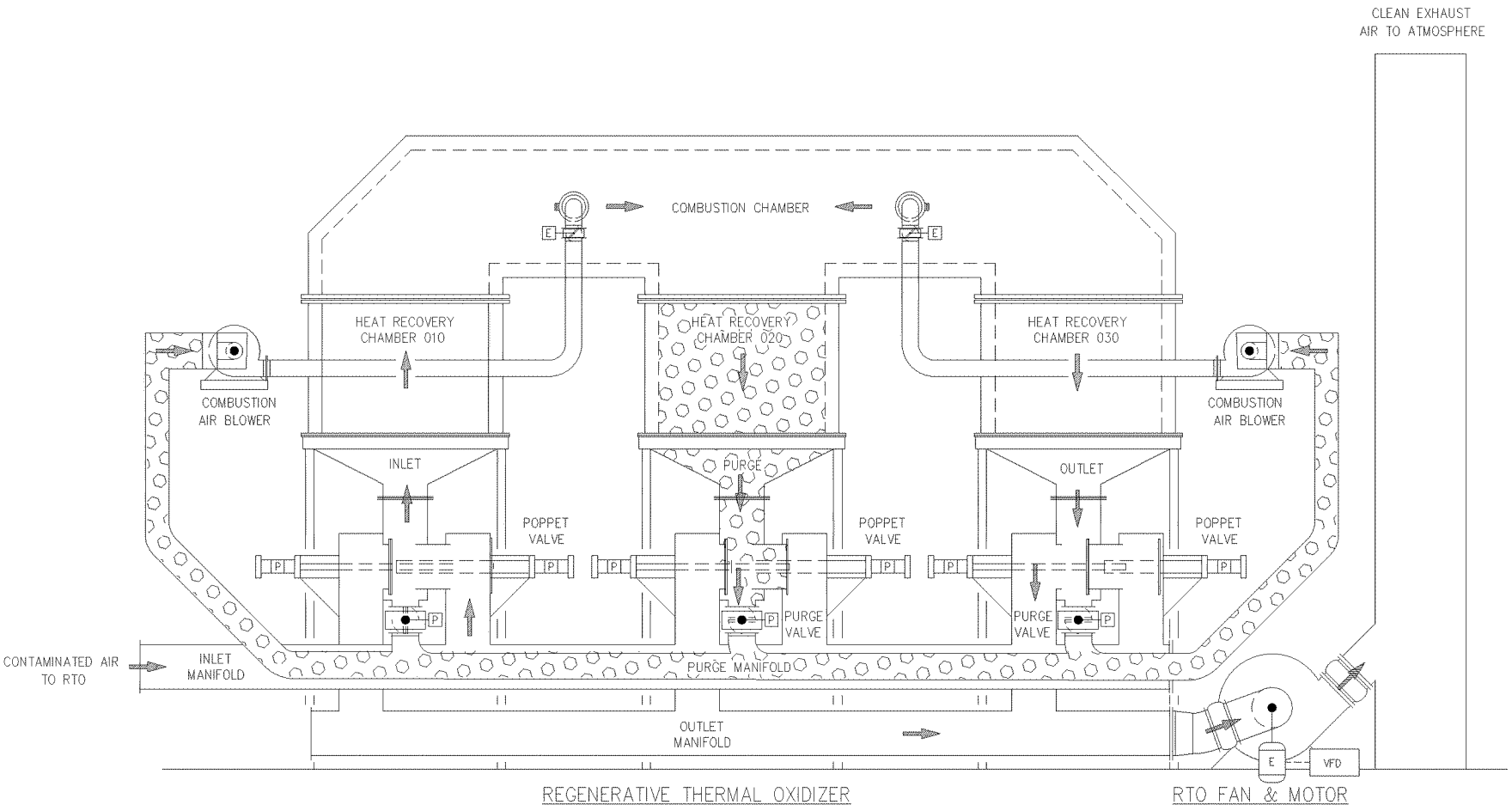
FIG. 10 shows the RTO with the second chamber in the combustion blower purge mode (first valve sequence), according to an embodiment.

FIG. 10 shows the RTO with the second chamber in the combustion blower purge mode (first valve sequence), according to an embodiment.

Figure 11:
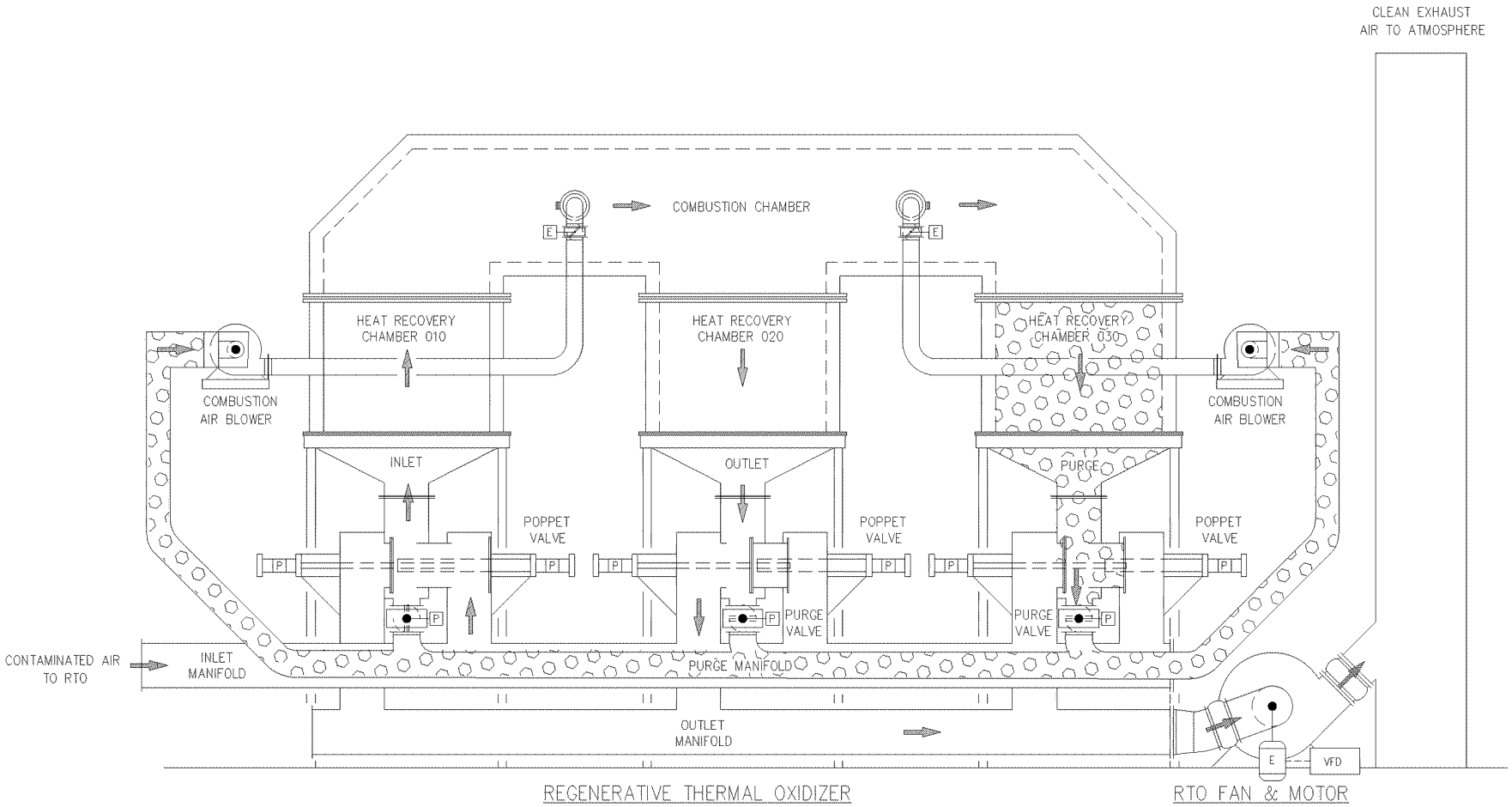
FIG. 11 shows the RTO with the third chamber in the combustion blower purge mode (third valve sequence), according to an embodiment.

FIG. 11 shows the RTO with the third chamber in the combustion blower purge mode (third valve sequence), according to an embodiment.

Figure 9:
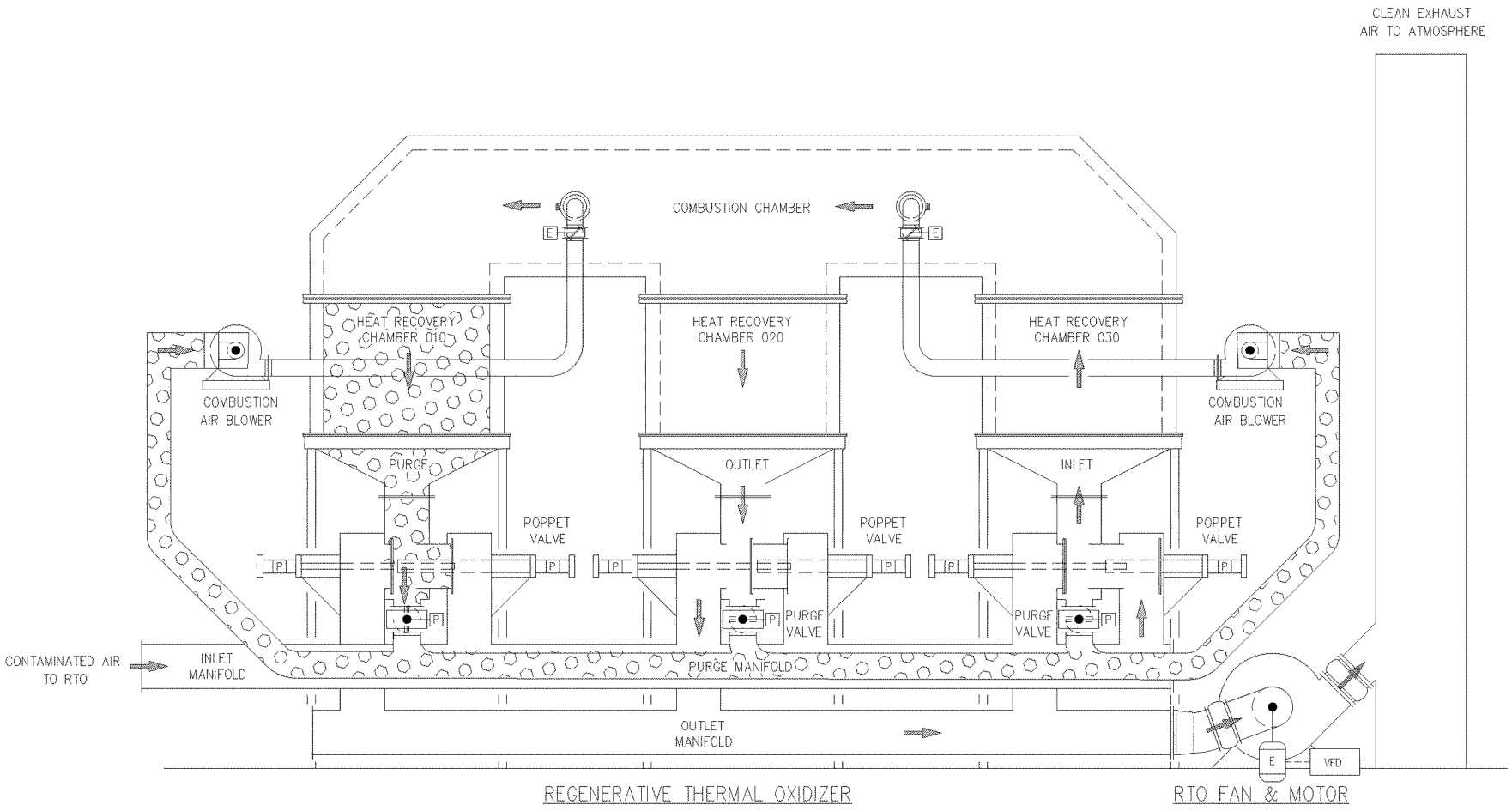
FIG. 9 shows the RTO with the first chamber in a combustion blower purge mode (second valve sequence), according to an embodiment.

FIGS. 9-11 all show the combustion blower purge mode for each of the three chambers. FIGS. 9-11 show chamber flushing or "purge" as extracting the volume of uncontrolled contaminants and reintroducing them through the combustion air system header as part of the combustion system of the RTO. Once the flushing volume enters the combustion air system header it is processed through the burner. The extraction of this volume can be done with the combustion blower for the burner or a separate blower system dedicated to flushing. Once flushing is complete the flushing valve closes and the chamber goes into outlet mode. This is followed by the chamber that was in inlet mode closing its diverter valve, then moving the main poppet valve to a closed inlet position, then opening its purge valve to repeat the next purge cycle.

Note that the purge manifold in the combustion blower purge mode connects all three chambers (each chamber has its purge valve possibly preventing flow to the purge manifold depending on the position of the respective purge valve). The purged gas from the chamber in the purge mode is extracted through the purge manifold (when the respective purge valve is opened) and then directed via one or more combustion air blowers into the combustion chamber where it is then processed through the burner. The purge manifold (from the three chambers) leads through one or more combustion air blowers into the combustion chamber.

Figure 12:
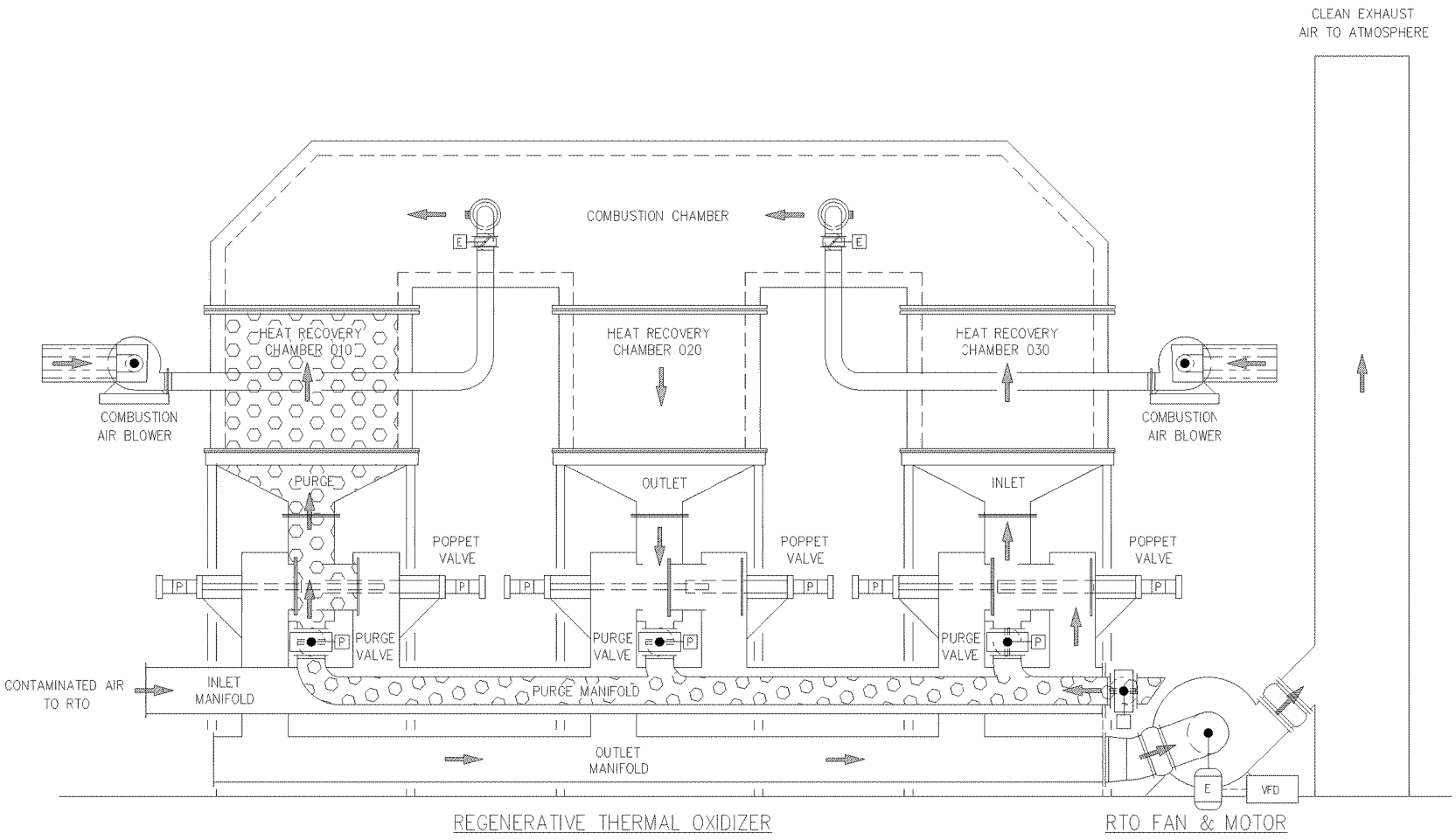
FIG. 12 shows the RTO with the first chamber in an outside air purge mode (second valve sequence), according to an embodiment.

FIG. 12 shows the RTO with the first chamber in an outside air purge mode (second valve sequence), according to an embodiment.

Figure 13:
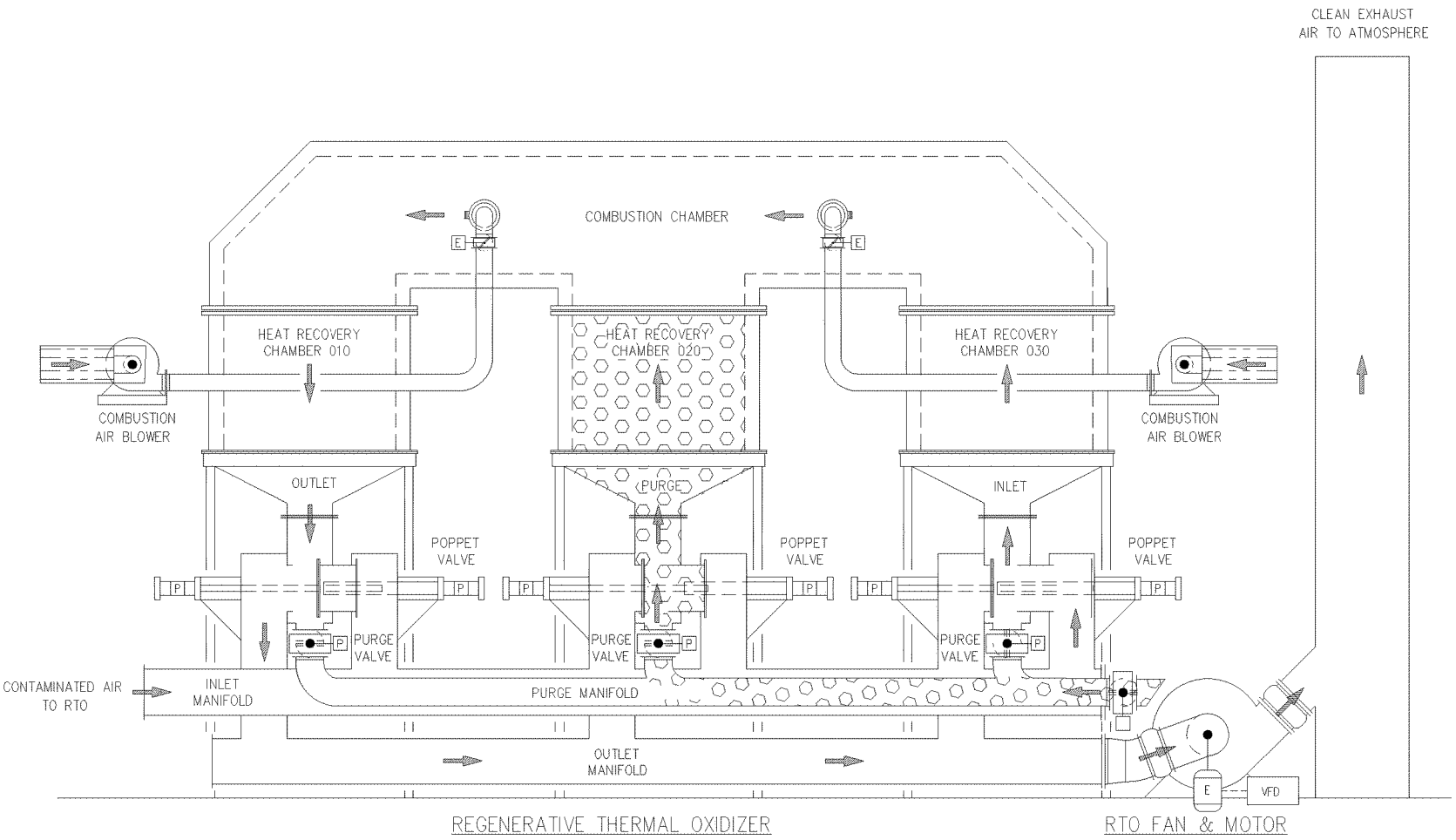
FIG. 13 shows the RTO with the second chamber in the outside air purge mode (first valve sequence), according to an embodiment.

FIG. 13 shows the RTO with the second chamber in the outside air purge mode (first valve sequence), according to an embodiment.

Figure 14:
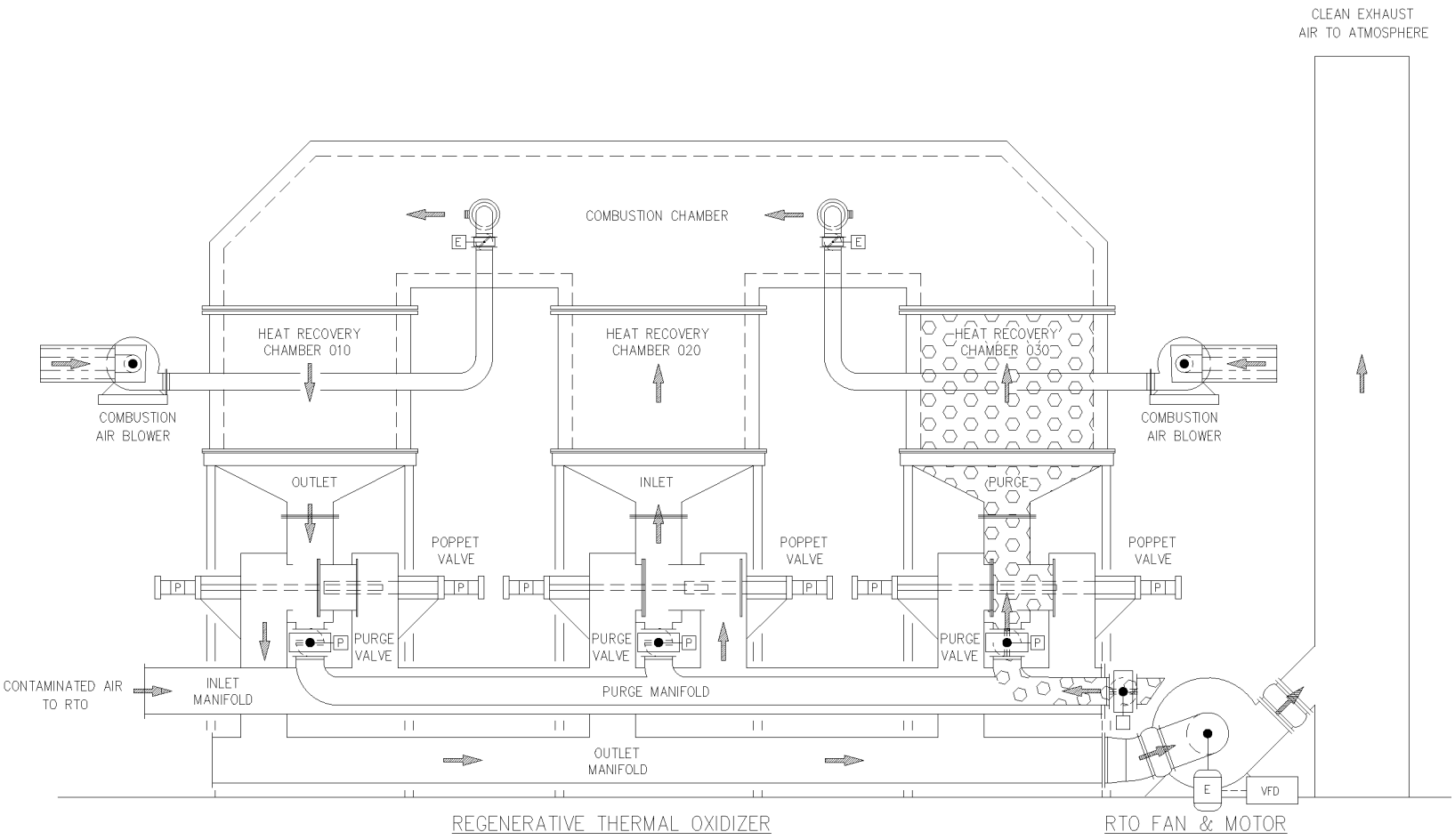
FIG. 14 shows the RTO with the third chamber in the outside air purge mode (third valve sequence), according to an embodiment.

FIG. 14 shows the RTO with the third chamber in the outside air purge mode (third valve sequence), according to an embodiment.

FIGS. 12-14 show the respective chamber flushing or "purge" as introducing outside air and flushing the volume of uncontrolled contaminants up into the combustion chamber for final destruction. The extraction of this volume can be done with a mode of force created by an induced draft fan or a separate fan dedicated to flushing. Once flushing is complete the flushing valve closes and the chamber goes into outlet mode. This is followed by the chamber that was in inlet mode closing its diverter valve, then moving the main poppet valve to a closed inlet position, then opening its purge valve to repeat the next purge cycle.

Figure 15:
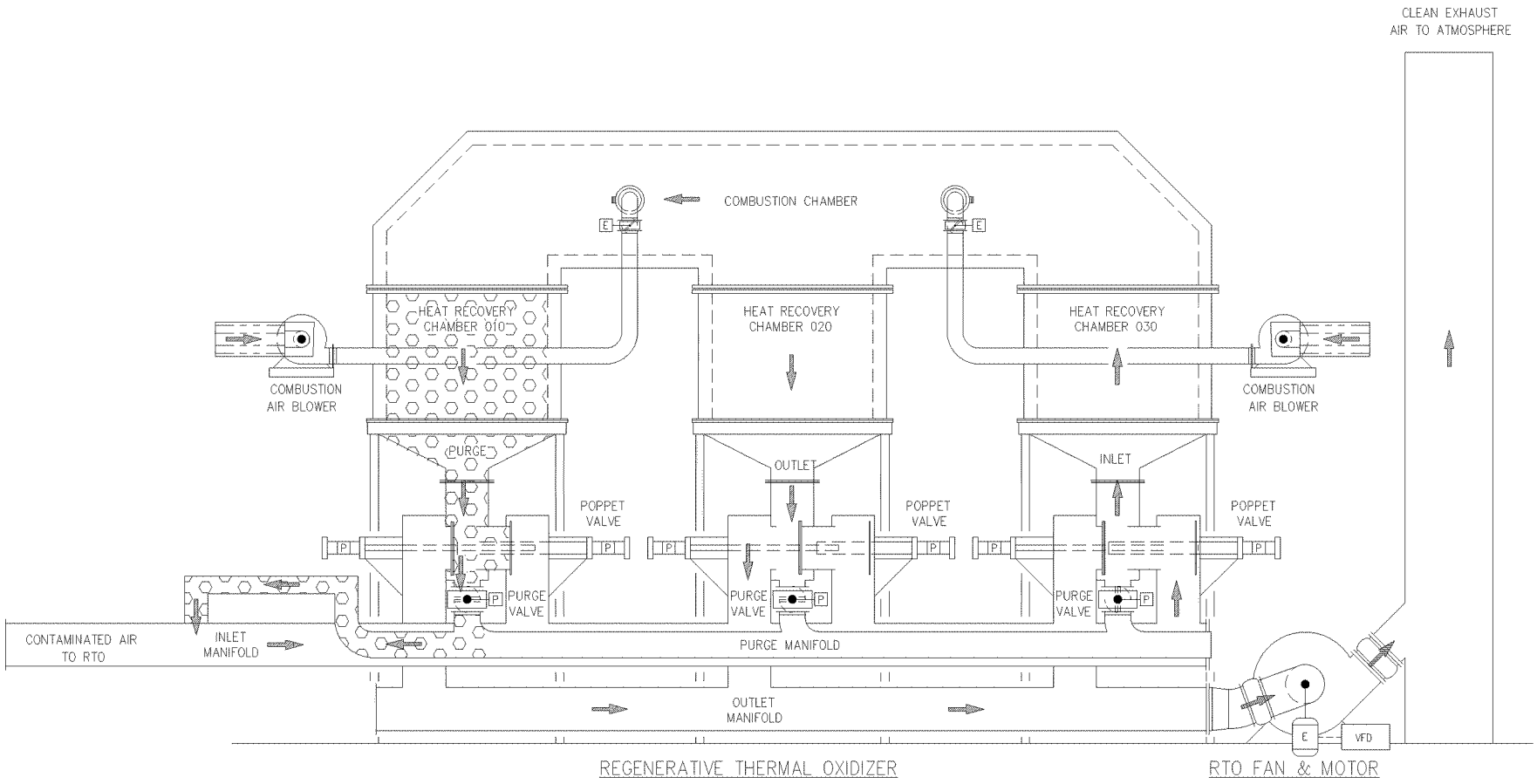
FIG. 15 shows the RTO with the first chamber in the untreated process purge mode, according to an embodiment.
Figure 16:
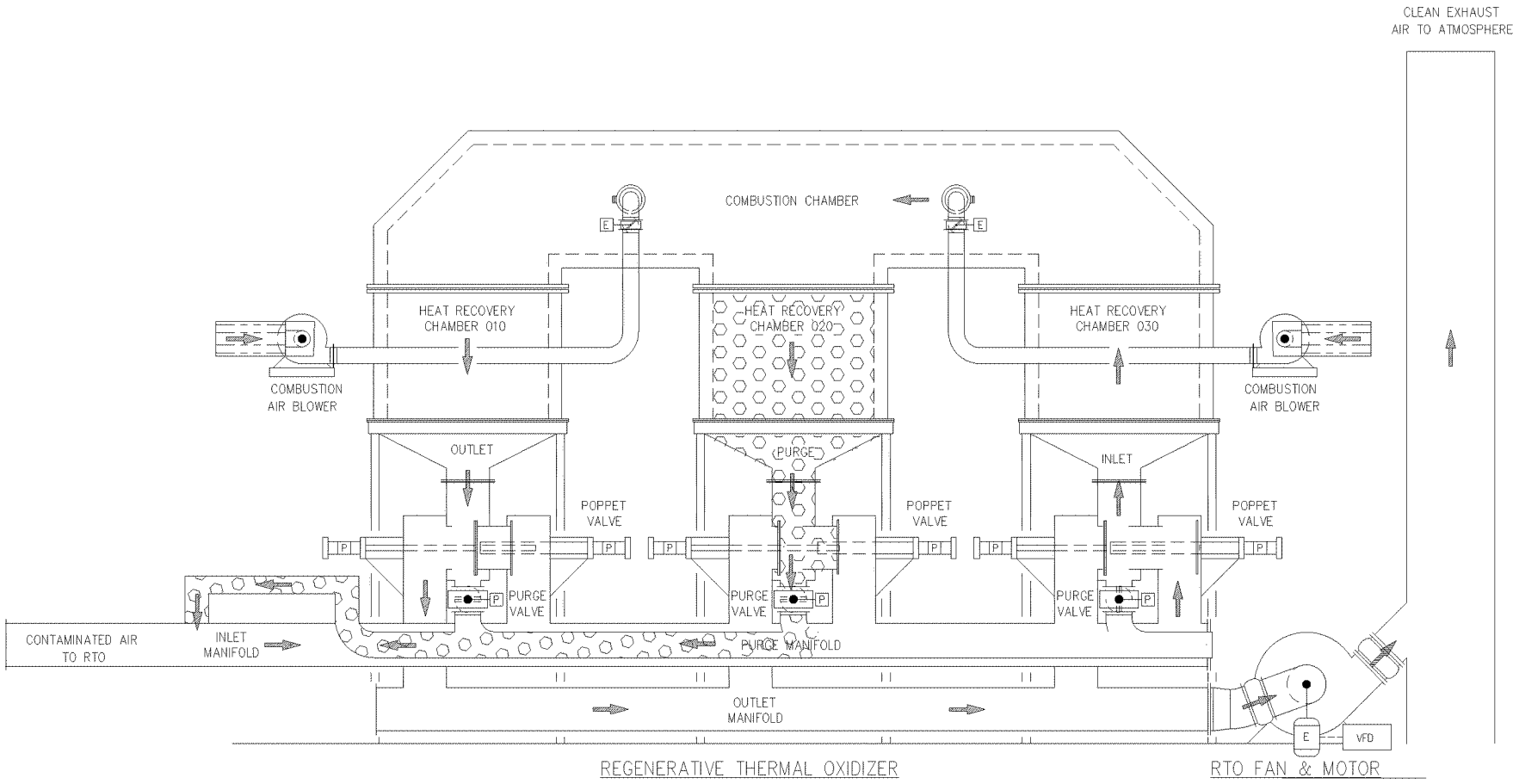
FIG. 16 shows the RTO with the second chamber in the untreated process purge mode, according to an embodiment.
Figure 17:
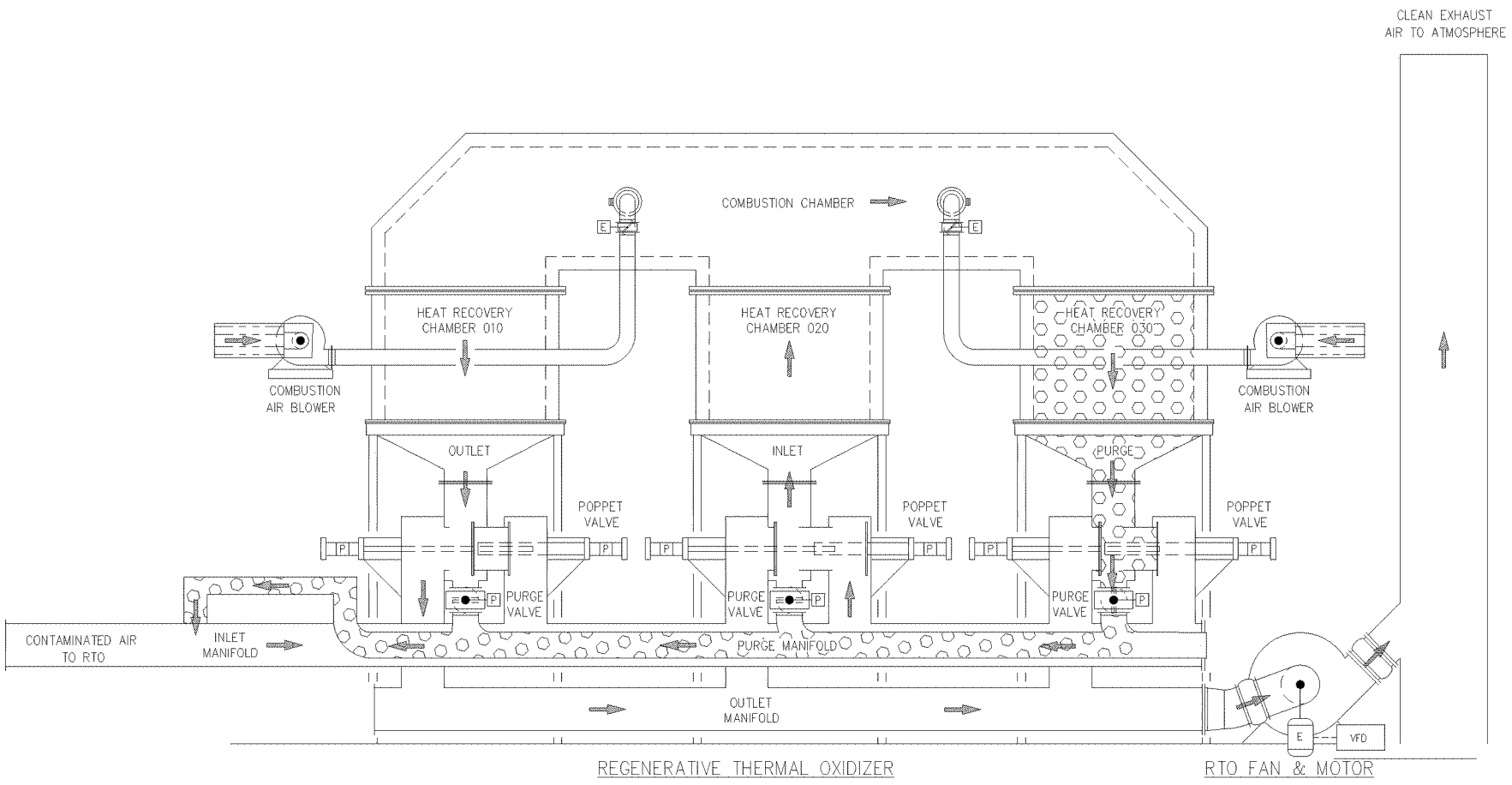
FIG. 17 shows the RTO with the third chamber in the untreated process purge mode, according to an embodiment.

FIG. 15 shows the RTO with the first chamber in the untreated process purge mode, according to an embodiment;

FIG. 16 shows the RTO with the second chamber in the untreated process purge mode, according to an embodiment;

FIG. 17 shows the RTO with the third chamber in the untreated process purge mode, according to an embodiment;

FIGS. 15-17 show the untreated process purge mode for each of the three chambers, wherein each respective chamber flushing or "purging" as introducing outside air and flushing the volume of uncontrolled contaminants up into the combustion chamber for final destruction. The extraction of this volume can be done with a mode of force created by an induced draft fan or a separate fan dedicated to flushing. Once flushing is complete the purge valve closes and the chamber goes into outlet mode. This is followed by the chamber that was in inlet mode will then go into the purge mode by opening its purge valve and the left valve remains retracted (sealing off the outlet manifold) and the right valve extends (sealing off the inlet manifold) so the next purge cycle can be repeated.

Note that in the untreated process purge mode (FIGS. 15-17), the purge manifold (which connects to each of the chambers and flow being controlled by the purge valve for each chamber) connects to the inlet manifold which then gets processed as any contaminated air being sent into the RTO via the inlet manifold.

An electronic and/or mechanical system can be utilized to control the operation of the valves (e.g., opening, closing, etc.) sot that each of the valve sequences can be implements. A computer can implement a timer and memory such that when the time for a particular valve sequence has ended, it would change the position of the necessary valves (e.g., open closed valves, close open valves, etc.) to implement the new sequence.

Figure 18:
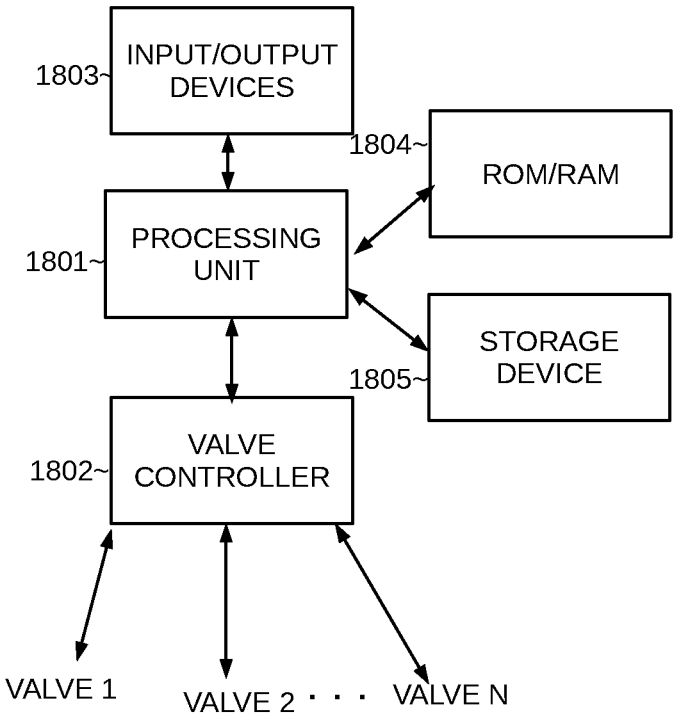
FIG. 18 is a chamber diagram of hardware that can be used to control all valves and all other components of the RTO, according to an embodiment.

FIG. 18 is a chamber diagram of hardware (e.g., a computer) that can be used to control all valves and all other components of the RTO, according to an embodiment.

A processing unit 1801 can be a microprocessor and any associated hardware (power supply, cache, etc.). The processing unit 1801 can also be an off the shelf computer. The processing unit 1801 is connected to an input/output device(s) 1803, which can be a keyboard (input device), LCD (output device), etc. The input/input devices 1803 would allow a person to communicate with the computer to program it and enable it to conduct any operations. The processing unit 1801 can also be connected to a ROM/RAM 1804 and also a storage device 1805 (e.g., a hard disk drive, flash memory, etc.). The processing unit 1801 can also be connected to a valve controller 1802 which is an interface which communicates with each valve and enables individual control of each of the valves used in the RTO, so that the processing unit 1801 can open/close individual valves according to a program, etc. The storage device 1805 can store a computer program which, when executed, would instruct the processing unit 1801 to automatically control the RTO to implement all of the progressions and valve sequences herein. The input/output devices 1803 can be used to interrupt a program (when necessary) to suspend (or turn off) the RTO automatic operations.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A regenerative thermal oxidizer apparatus, comprising:

a first chamber opening into an inlet manifold, an outlet manifold, and a purge manifold, a first chamber first valve controlling access from the first chamber to the outlet manifold, a first chamber second valve controlling access from the first chamber to the inlet manifold, and a first chamber purge valve controlling access from the first chamber to the purge manifold;

a second chamber opening into the inlet manifold, the outlet manifold, and the purge manifold, a second chamber first valve controlling access from the second chamber to the outlet manifold, a second chamber second valve controlling access from the second chamber to the inlet manifold, and a second chamber purge valve controlling access from the second chamber to the purge manifold;

a third chamber opening into the inlet manifold, the outlet manifold, and the purge manifold, a third chamber first valve controlling access from the third chamber to the outlet manifold, a third chamber second valve controlling access from the third chamber to the inlet manifold, and a third chamber purge valve controlling access from the third chamber to the purge manifold;

a processing unit configured to selectively control the first chamber first valve, the first chamber second valve, the second chamber first valve, the second chamber second valve, the third chamber first valve, the third chamber second valve, such that the processing unit is configured to put the regenerative thermal oxidizer apparatus into a first sequence whereby the processing unit is configured to operate the first chamber first valve to seal the first chamber from the outlet manifold, and to operate the first chamber second valve to expose the first chamber to the inlet manifold, and to operate the second chamber first valve to expose the second chamber to the outlet manifold and seal the second chamber from the inlet manifold, and to operate the third chamber first valve to seal the third chamber from the outlet manifold and to operate the third chamber second valve to seal the third chamber from the inlet manifold, wherein the regenerative thermal oxidizer apparatus is configured to enable contaminated gas to enter the inlet manifold and to enable processed gas to exit the regenerative thermal oxidizer apparatus via the outlet manifold, wherein the first chamber first valve, the first chamber second valve, the second chamber first valve, the second chamber second valve, the third chamber first valve, the third chamber second valve are all independently actuatable poppet valves, each of the poppet valves comprising a blade which is movable between a respective first position and a respective second position, wherein a mode of each of the first chamber. second chamber, and third chamber is selected by positioning associated valves of each chamber to a respective configuration;

wherein when the first chamber first valve seals the first chamber from the outlet manifold and the first chamber second valve exposes the first chamber to the inlet manifold then, the first chamber is in an inlet mode, and when the first chamber first valve exposes the first chamber to the outlet manifold and the inlet manifold is sealed from the first chamber then the first chamber is in an outlet mode, and when the first chamber first valve seals the first chamber from the outlet manifold and the first chamber second valve seals the inlet manifold from the first chamber then the first chamber is in a purge mode wherein gas in the first chamber exits through the first chamber purge valve, wherein the first chamber first valve, the first chamber second valve, the second chamber first valve, the second chamber second valve, the third chamber first valve, the third chamber second valve are all independently actuatable poppet valves-, each of the poppet valves comprising a blade which is movable between a respective first position and a respective second position, wherein a mode of each of the first chamber. second chamber, and third chamber is selected by positioning associated valves of each chamber to a respective configuration;

wherein when the third chamber first valve seals the third chamber from the outlet manifold and the third chamber second valve exposes the third chamber to the inlet manifold then the third chamber is in an inlet mode, and when the third chamber first valve exposes the third chamber to the outlet manifold and the inlet manifold is sealed from the third chamber then the third chamber is in an outlet mode, and when the third chamber first valve seals the third chamber from the outlet manifold and the third chamber second valve seals the third chamber from the inlet manifold then the third chamber is in a purge mode wherein gas in the third chamber exits through the third chamber purge valve, the purge manifold connects the first chamber the second chamber and the third chamber, the first chamber purge valve configured to control flow between the first chamber and the purge manifold, the second chamber purge valve configured to control flow between the second chamber and the purge manifold, and the third chamber purge valve configured to control flow between the third chamber and the purge manifold, wherein the purge manifold leads to a combustion chamber, wherein the processing unit is configured to automatically position the first chamber first valve, the first chamber second valve, the second chamber first valve, the second chamber second valve, the third chamber first valve, the third chamber second valve, in accordance with a current sequence, and upon expiration of a predetermined sequence duration, to effect a transition to a next sequence by causing respective valves to assume their respective states for the next sequence, thereby interchanging operating modes of the first, second, and third chambers and continuing sequences in succession during continuous operation.

2. The apparatus as recited in claim 1, wherein the processing unit is further configured to, in the first sequence, open the third chamber purge valve while the first chamber purge valve is in a closed position and the second chamber purge valve is in a closed position, such that in the first sequence the third chamber is in the purge mode, wherein gas in the third chamber exits through the third chamber purge valve into the purge manifold leading to the combustion chamber, wherein the processing unit is configured to selectively control the first chamber purge valve the second chamber purge valve and the third chamber purge valve.

* * * * *